United States Patent [19]

Baugh

[11] Patent Number: 4,615,314

[45] Date of Patent: Oct. 7, 1986

[54] REVERSIBLE OIL PAN ASSEMBLY

[75] Inventor: James D. Baugh, Greensburg, Ind.

[73] Assignee: Cummins Engine Company, Inc., Columbus, Ind.

[21] Appl. No.: 337,406

[22] Filed: Jan. 6, 1982

Related U.S. Application Data

[63] Continuation of Ser. No. 90,478, Nov. 1, 1979, abandoned.

[51] Int. Cl.[4] ..... F02M 1/04

[52] U.S. Cl. ..... 123/195 C; 123/196 R; 123/196 A; 184/6.5; 184/106

[58] Field of Search ..... 123/196 R, 196 A, 195 R, 123/195 C; 184/6.5, 106; 248/65, 74 A

[56] References Cited

U.S. PATENT DOCUMENTS

| | | | |
|---|---|---|---|
| 2,226,595 | 12/1940 | Swenson | 123/195 C |
| 3,216,685 | 11/1965 | Raymond | 248/74 A |
| 3,504,769 | 4/1970 | Mettig | 123/196 R |
| 3,653,464 | 4/1972 | Jacobsen et al. | 184/6.5 |
| 4,068,646 | 1/1978 | Hnojsky | 184/6.5 |

FOREIGN PATENT DOCUMENTS

| | | | |
|---|---|---|---|
| 1123160 | 2/1962 | Fed. Rep. of Germany | 123/196 A |

*Primary Examiner*—Craig R. Feinberg

*Attorney, Agent, or Firm*—Sixbey, Friedman & Leedom

[57] ABSTRACT

An adaptor (ladder frame 10) and oil pan assembly (14), including a method of assembly therefor, is disclosed for mounting on an internal combustion engine block (2) equipped with a lubrication system designed to receive oil for recirculation through an inlet port (22) in the ladder frame (10) offset from the center of the oil pan assembly (14) when the assembly (14) is mounted in one of two reversed positions. The oil pan assembly (14) includes an asymmetrically offset oil pan reservoir (27) and integrally connected sump pipe (28, 48) within the interior of the pan shaped in accordance with the intended position of the oil pan assembly when mounted on the engine. The shape of the sump pipe (28, 48) is selected to provide automatic alignment and connection between the reservoir (27) and the inlet port (22) when the oil pan assembly (10) and sump pipe (28, 48) are simultaneously mounted on the engine. The sump pipe (28, 48) includes, in addition, filter means in the form of slots (62) contained in one leg of the sump pipe. The ladder frame is characterized by an oil pump receiving recess 16 and internalized oil flow passages (20*a* and 20*b*) to further reduce assembly costs.

8 Claims, 11 Drawing Figures

REVERSIBLE OIL PAN ASSEMBLY

This application is a continuation, of application Ser. No. 90,478, filed 11/1/79 now abandoned.

DESCRIPTION

1. Technical Field

This invention relates to oil pan assemblies for internal combustion engines. More particularly, this invention relates to an oil pan assembly which includes an oil supply pipe integrally attached to the interior of the oil reservoir and shaped to permit simultaneous mounting of the assembly on an internal combustion engine.

2. Background Art

The escalating costs of manufacturing components for internal combustion engines has led engine manufacturers to seek component designs which are versatile and may be used in more than one engine application. Substantial savings can be realized by providing engine components which have this versatility. It is particularly cost saving to be able to manufacture a basic component which may be mounted on the engine in more than one orientation to adapt the engine for different end purposes. One internal combustion engine component for which reduced manufacturing costs can be realized by modifying the basic part of the component is the oil pan assembly. It is currently necessary to manufacture oil pan assemblies in different shapes to conform to the environment in which the engine is to be used, such as the configuration of the engine receiving cavity when the engine is used to drive a vehicle. The position of the vehicle axle relative to the front of the engine customarily limits the placement of the oil pan reservoir, which, by necessity, is the deepest portion of the oil pan. Manufacture of different shaped oil pans is complicated by the need for an oil supply line or sump pipe to transport oil from the reservoir to the engine lubrication system.

Forming an oil pan reservoir which may be mounted in more than one orientation and then providing the necessary fluid connection of the reservoir with the engine lubrication system is more difficult when the lubrication system is contained entirely within the engine block and oil pan assembly than when the lubrication system employs externally mounted oil flow lines. Such internally contained lubrication systems normally include an inlet port in the lower block section which is asymmetrically positioned within the perimeter of the oil pan when the oil pan is mounted on the engine. This necessitates placement of the oil supply line or sump pipe so that it connects with the inlet port when the oil pan reservoir is mounted in the desired orientation for different models of this type of engine. Utilization of the types of oil supply lines or sump pipes known in the prior art does not facilitate easy connection between the inlet port and the oil pan reservoir when the oil pan assembly is mounted on an engine with an entirely internally contained lubrication system. One technique for overcoming this problem is to employ an oil supply line mounted externally to the oil pan assembly to provide a connection between the reservoir and the engine lubrication system such as that used by the assignee of the present invention on its Model 855 C.I.D. engine. However, this technique presents several disadvantages. In particular, externally positioned oil supply lines are susceptible to leaks at the connection points and require careful monitoring to insure that connections are intact.

Moreover, there is always a possibility of leaks resulting from damage to the line itself. Externally mounted flow lines also impart a cluttered exterior appearance which can detrimentally affect customer acceptance of the engine design.

Utilization of an oil supply line within the interior of the oil pan assembly avoids the leakage problems associated with an externally positioned supply line. However, the interior supply lines known in the prior art, such as the one disclosed in U.S. Pat. No. 3,653,464, result in increased assembly costs by requiring the supply line and oil pan to be mounted separately during final engine assembly. The type of interior oil supply line disclosed in U.S. Pat. No. 3,653,464 requires the line to be mounted in a depending position to extend downwardly into the oil pan reservoir. There is no suggestion that the oil pan assembly design disclosed in U.S. Pat. No. 3,653,464 could be mounted in a second reversed orientation for use in a different engine application than that shown.

While it is known in the prior art to provide fluid conductor tubes mounted within an oil pan reservoir, and to shape the tube in accordance with a desired end purpose as is disclosed in U.S. Pat. No. 2,437,013, such oil pan reservoirs are not shaped to permit adaptation of the assembly to different end uses by the technique of reversibly mounting the oil pan on the disclosed assembly.

As is conventionally recognized, it is advantageous to provide in conjunction with an oil pan assembly a means for filtering the oil conducted from the oil pan reservoir to the oil pump to prevent damage to the engine caused by the circulation of sludge and other contaminants. However, the available prior art oil filtering systems are complex multi-part structures such as those disclosed in U.S. Pat. Nos. 3,888,227 and 3,888,228. While the filters disclosed in these patents function effectively to clean the oil to be recirculated, they are costly to manufacture, assemble and repair. The use of such a structure in an oil pan assembly designed with the goal of reducing significantly manufacturing costs would obviously be self-defeating. Oil pick-up devices conventionally attached to oil sump pipes or supply lines, such as the one shown in U.S. Pat. No. 3,653,464, also are costly to manufacture and assemble and would fail to reduce manufacturing costs.

DISCLOSURE OF THE INVENTION

The basic object of this invention is to overcome the disadvantages of the prior art as listed above and, in particular, to provide an oil pan assembly characterized by versatility and low manufacturing and assembly costs where the oil pan assembly is adapted to be mounted on an internal combustion engine equipped with a lubrication system designed to obtain oil from the oil pan assembly through an inlet port on the engine positioned asymmetrically within the perimeter of the oil pan assembly when the assembly is mounted on the engine.

It is yet another object of the present invention to provide an oil pan for mounting on an internal combustion engine with an asymmetrically positioned oil inlet port in an first orientation and in a second reversed orientation and an oil supply line or sump pipe integrally connected to the oil pan interior and shaped to provide automatic alignment and connection of the oil supply line and the inlet port when the oil pan assembly is mounted on the engine in the desired orientation.

It is a further object of the present invention to provide a low cost versatile oil pan assembly which includes an easily formed oil filtering means integral wih the oil supply line or sump pipe.

It is still another object of the present invention to provide a low cost oil pan assembly which reduces engine noise.

It is still another object of the present invention to provide an oil pan assembly for an internal combustion engine with an asymmetrically positioned oil inlet port which includes an oil pan with an asymmetrically offset oil reservoir to allow placement of the oil pan forwardly or rearwardly on the engine and an oil supply line integrally attached to the interior of the oil pan for connection of the reservoir and the inlet port, the shape of the oil supply line being selected to provide automatic alignment with the inlet port when the oil pan and supply tube are mounted as a unit on the engine in the desired orientation.

Yet another object of the invention is to provide a method for forming an oil pan assenmbly by the step of forming an oil pan which may be reversibly mounted on an engine to adapt the engine to different end uses combined with the steps of forming a supply line in a shape dependent on the intended orientation of the oil pan and of integrally mounting the supply line on the reversible oil pan to cause one end of the supply line to automatically align with the lubrication inlet port of the engine when the oil pan assembly is mounted as a unit on the engine.

Yet another object of this invention is to provide an oil pan assembly and lower engine block portion or ladder frame characterized by an oil pump housing integrally formed within the ladder frame and communicating with the reservoir of the oil pump through a passageway formed integrally with the ladder frame and a supply line integrally mounted to the oil pan for connection with the ladder frame in a desired configuration thereby to reduce overall lubrication system manufacturing costs.

Other and more specific objects of the invention may be understood from the following Brief Description of the Drawings and Best Mode for Carrying Out the Invention.

BEST MODE FOR CARRYING OUT THE INVENTION

Figure 1:
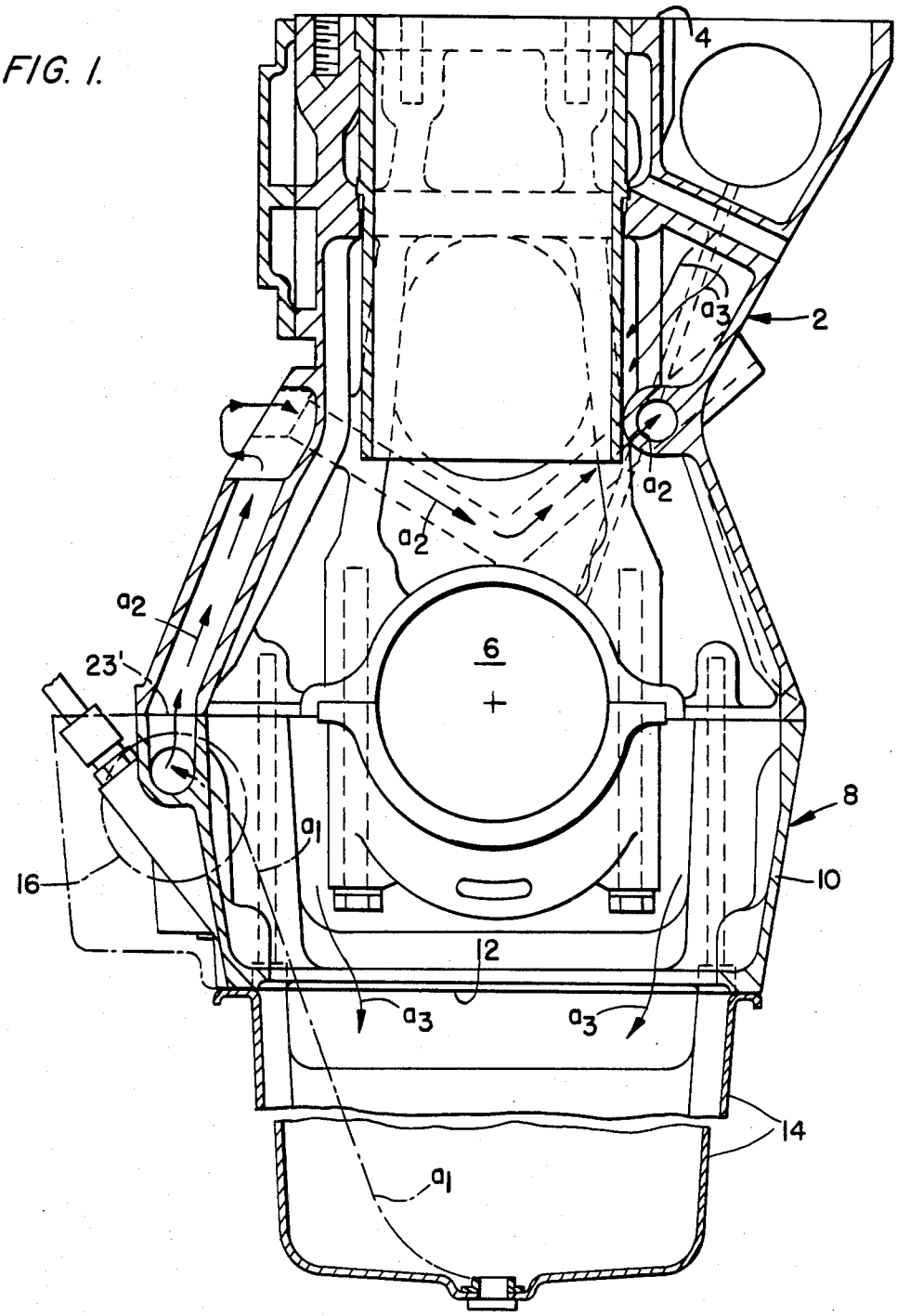
FIG. 1 is a broken cross sectional view of an engine block with the oil pan assembly of the present invention mounted in place.

Referring generally to FIG. 1 one embodiment of the subject invention is illustrated as one component of an engine block assembly of the type described in U.S. patent application Ser. No. 022,647 filed Mar. 21, 1979, assigned to the same assignee as the subject invention and incorporated herein by reference. An important feature of the upper engine block disclosed in application Ser. No. 022,647 is that the lubrication flow circuit is contained virtually entirely integrally within the block, thereby eliminating substantially all external flow lines and the attendant problems of oil leakage resulting from seal failure and of lubrication system breakdown resulting from damage to the external flow lines. As will be explained more fully hereinbelow, the subject invention is directed to the concept of extending internally the lubrication flow circuit into the oil pan assembly through the lower block portion or crankcase section (referred to in application Ser. No. 022,637 as a "ladder frame"). In particular, internalized flow passages have been incorporated integrally in the ladder frame and oil pan assembly in a manner to achieve manufacturing and assembly cost reductions and added versatility in adapting the overall engine assembly to different end use environments.

Particular reference is now made to FIG. 1, which shows a cross sectional view of the composite engine block referred to above. The block includes a main frame or cylinder block 2 having a head engaging surface 4 and a crankshaft receiving cavity 6 on opposed sides of the main frame 2. The lower engine block or crankshaft portion 8 includes a ladder frame 10 as described in the above noted U.S. application Ser. No. 022,647. Ladder frame 10 includes a recess 16 (shown in dashed lines) for receiving an oil pump (not shown) adapted to draw oil up from the oil pan assembly 14 mounted on lower surface 12 of ladder frame 10 (as illustrated by dashed arrow $a_1$) and force it upwardly through passages in the ladder frame 10 and upper block 2 (as illustrated by arrows $a_2$). The lubrication circuit is completed by gravity return of oil through a labyrinth of open spaces within the composite block leading back to the oil pan as illustrated by arrows $a_3$. The details of the lubrication system contained in the cylinder block are fully described in the above-mentioned U.S. patent application Ser. No. 022,647.

Figure 2:
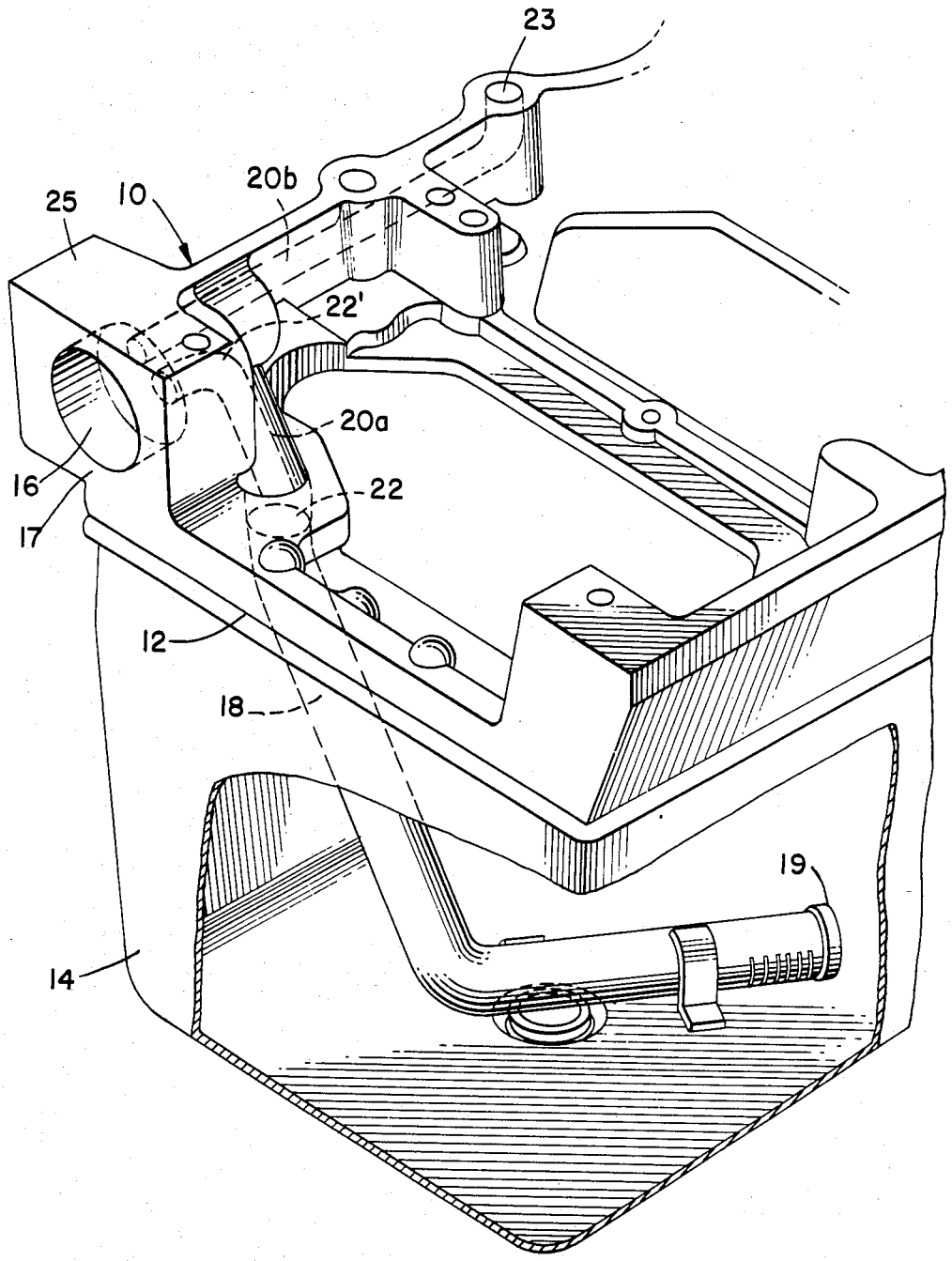
FIG. 2 is a partially cut away perspective of the lower engine block, the oil pan assembly and oil supply line of the present invention.

For a more detailed description of the subject invention, reference is now made to FIG. 2, which is a partially cut away perspective view of the ladder frame 10 and oil pan assembly. The oil pump receiving recess 16 opens into end wall 17 of ladder frame 10 and communicates with the oil pan assembly 14 through passage 20*a* (shown in dashed lines), also fully enclosed within the ladder frame 10. Recess 16 is shaped to receive the internal workings of an engine oil pump (not shown) driven by a shaft extending into recess 16 through the opening formed in surface 17. The manner by which the oil pump is driven through a gear train connected with the engine crankshaft is more fully disclosed in U.S. patent application Ser. No. 974,562 filed Dec. 29, 1978 and assigned to the same assignee as the subject application. Oil is supplied to recess 16 by a supply line or sump pipe 18 one end of which 19 communicates with the lowermost portion of the internal cavity of oil pan assembly 14 and the other end of which communicates with passage 20*a* at an inlet port 22 (shown in dashed lines) formed on the lower surface 12 of ladder frame 10. The other end of passage 20*a* opens through an outlet port 22' into recess 16. After being pressurized by the oil pump, the oil is directed into the upper block 2 by passage 20*b* (shown in dashed lines) contained within ladder frame 10 and connected at one end to recess 16 and at the other end with a port 23 formed on the upper surface 25 of ladder frame 10. Port 23 is positioned to align with a corresponding port 23' (FIG. 1) formed in the lower surface of upper block 2.

Figure 3:
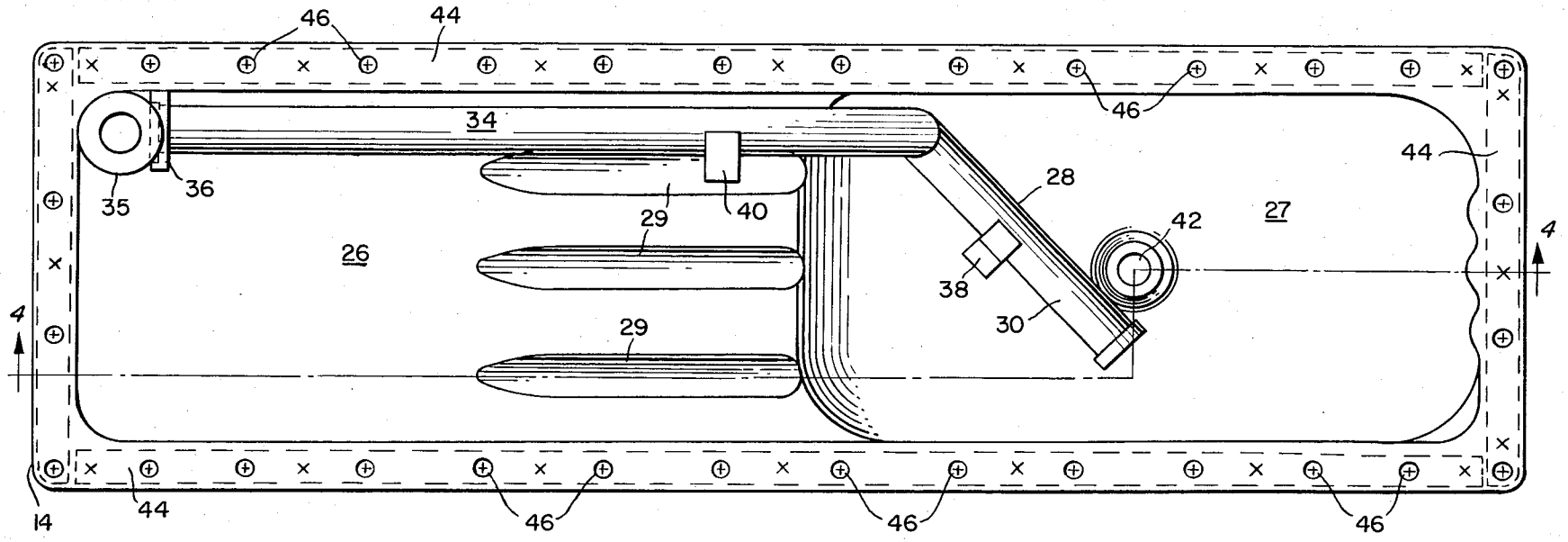
FIG. 3 is a top elevational view of one embodiment of the oil pan assembly formed in accordance with the present invention.
Figure 4:
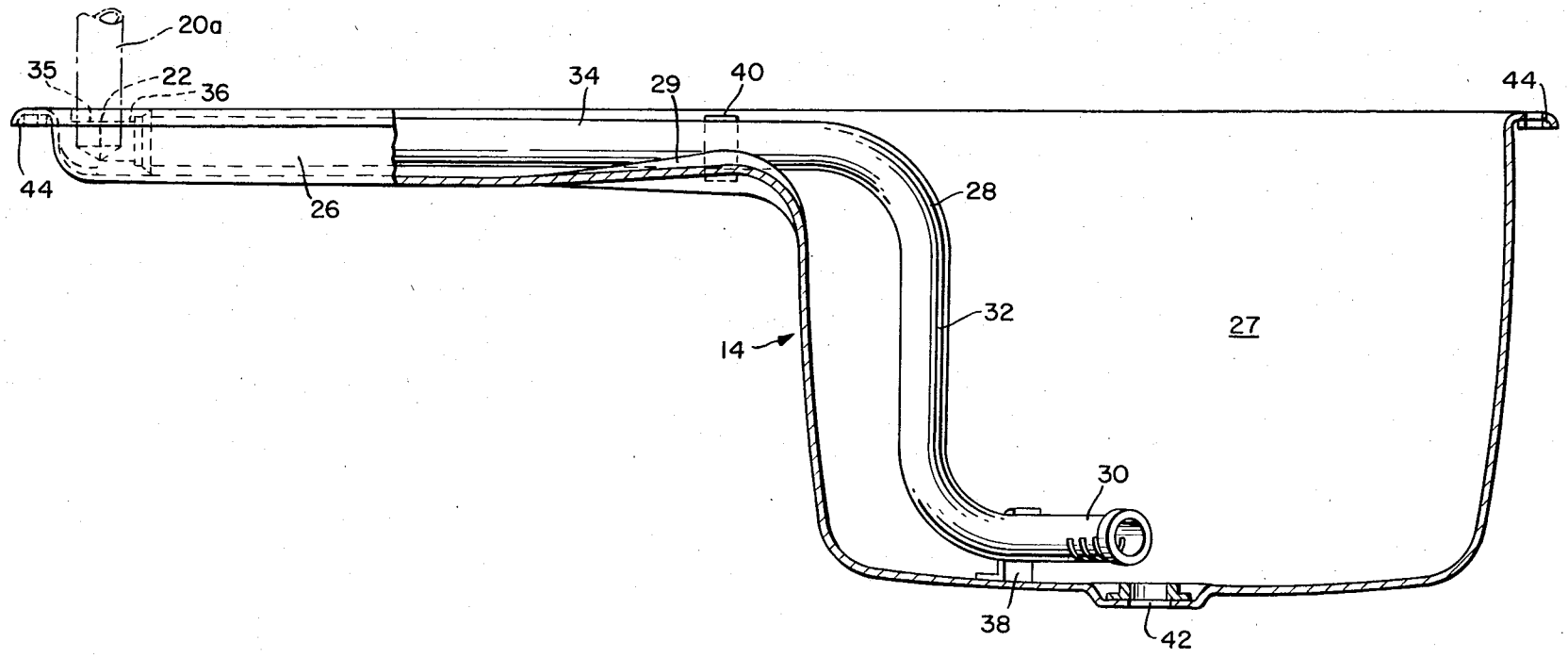
FIG. 4 is a cross sectional view of the oil pan assembly of the present invention taken along line 4—4 of FIG. 3.

FIGS. 3 and 4 illustrate one embodiment of the subject invention including an oil pan assembly 14 intended for mounting on the ladder frame 10 of FIGS. 1 and 2 in a given orientation in order to cause the lowest portion of the oil pan assembly 14 to be positioned below the portion of ladder frame 10 which is opposite the end adjacent inlet port 22. As best shown in FIG. 4, the oil pan assembly 14 includes shallow trough portion 26 into which oil from the engine drains, a deep reservoir portion 27 asymmetrically offset from the oil pan assembly center for holding oil to be recirculated and an oil supply line or sump pipe 28 which serves as a conduit for conducting oil from the lower interior portion of reservoir 26 to inlet port 22 (shown in dashed lines) in the engine ladder frame 10. FIGS. 3 and 4 depict an oil pan assembly in which the trough portion 26 of the assembly is designed to be located directly under the inlet port 22 (shown in dashed lines) in the engine ladder frame 10. FIGS. 3 and 4 depict an oil pan assembly in which the trough portion 26 of the assembly is designed to be located directly under the inlet port 22 (shown in dashed lines). In this orientation, reservoir 27 would be located at some distance from the inlet port 22 when the assembly is mounted on the engine and sump pipe 28 must be shaped to conduct oil efficiently from the lower interior portion of reservoir 27 through the trough portion 26 to the inlet port 22. This has been accomplished by forming sump pipe 28 with a first leg 30 shaped to be positioned parallel to the lower wall of reservoir 27 when the pipe is integrally attached to the oil pan assembly 14, a second leg 32 which extends upwardly generally vertically to a point near the top of the reservoir where leg 32 connects with a third leg 34 which extends generally horizontally through trough portion 26 to connect with inlet port 22. Collar 36 supports the terminal end 35 of third leg 34 and provides a tight connection with inlet port 22. First leg 30 and third leg 34 are maintained in spaced parallel relationship with the bottom walls of reservoir 27 and trough 26, respectively, by the use of substantially reverse S-shaped clips 38 and 40, which will be described in more detail hereinbelow. These clips function, in addition, to integrally connect sump pipe 28 to the interior of the oil pan assembly. Reservoir 27 further includes a drain 42 of the type conventionally employed to facilitate the removal of sludge or dirty oil.

Oil pan assembly 14 includes around the upper perimeter of the reservoir and trough a flange 44 containing bolt receiving holes 46 for mounting the assembly 14 to the bottom surface 12 (FIGS. 1 and 2) of the engine ladder frame. When the assembly 14 is mounted with the reservoir in the orientation shown in FIGS. 3 and 4, end 36 of sump pipe 28 is correctly aligned for automatic connection with inlet port 22.

Trough 26 further includes parallel elongated horizontal depressions 29 which perform a rigidifying and noise reducing function when oil pan assembly 14 is mounted on the engine.

Figure 5:
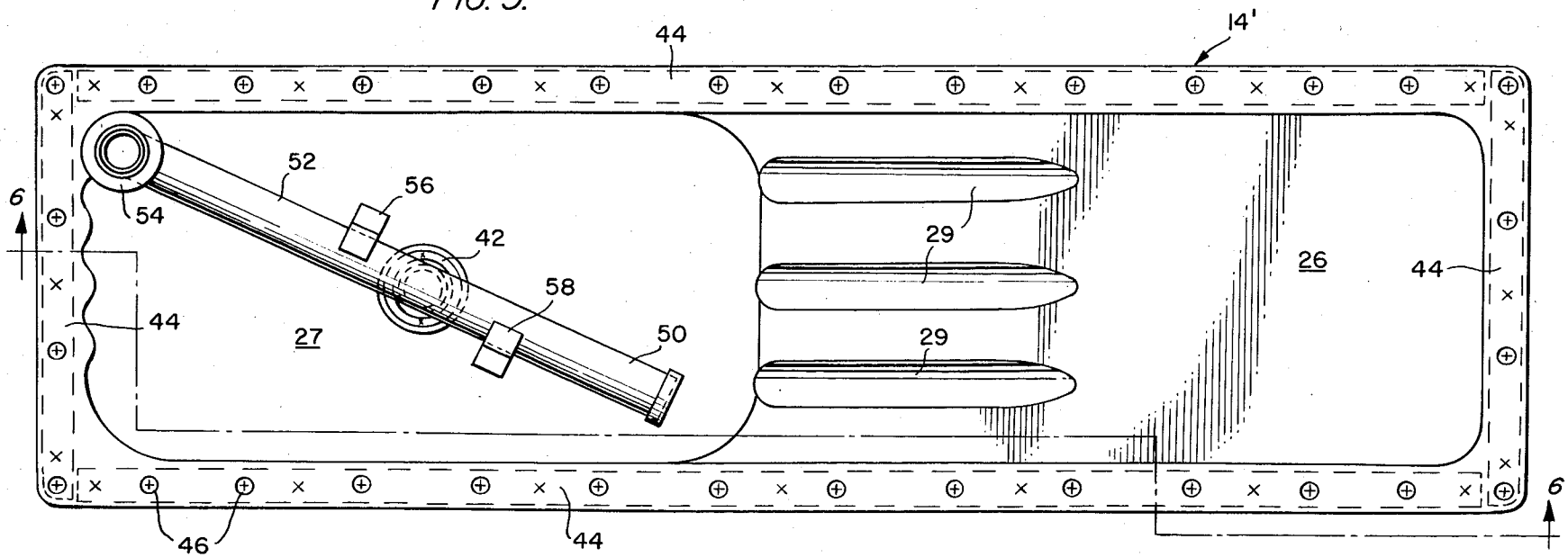
FIG. 5 is a top elevational view of another embodiment of the oil pan assembly formed in accordance with the present invention.
Figure 6:
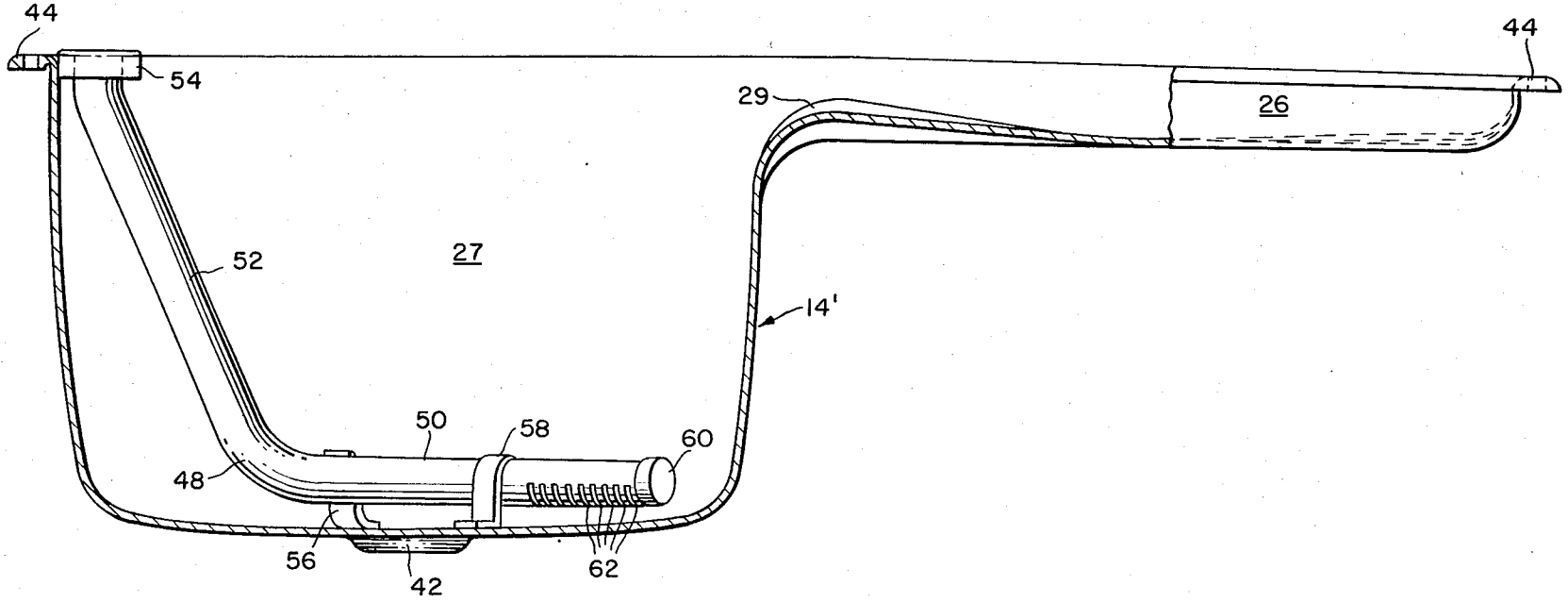
FIG. 6 is a cross sectional view of the oil pan assembly of the present invention taken along line 6—6 of FIG. 5.

FIGS. 5 and 6 illustrate an alternative embodiment of the subject invention wherein the oil pan assembly 14' is designed to be mounted on the engine in a reversed orientation from that shown in FIGS. 3 and 4. In particular the reservoir 27 of assembly 14' is arranged to be located directly below inlet port 22 and requires a different configuration sump pipe from that shown in FIGS. 3 and 4 to provide the necessary connection between the reservoir 27 and the inlet port 22. It should be noted that the oil pan itself as shown in FIGS. 5 and 6, which includes reservoir 27, trough 26 and flange 44, is exactly the same configuration as that shown in FIGS. 3 and 4; it has merely been turned around so that reservoir 27 is where trough 26 was in FIGS. 3 and 4. Because of the proximity of reservoir 27 to inlet port 22, a much simpler sump pipe configuration may be used in the assembly of FIGS. 5 and 6. Sump pipe 48 is formed with a first leg 50, which is substantially parallel to the bottom wall of the reservoir 27, and a second leg 52, which extends substantially vertically to the top of reservoir 27 to engage collar 54, which supports the terminal end of pipe 48 and facilitates its connection with inlet port 22. Clips 56 and 58 maintain first leg 50 of sump pipe 48 in spaced parallel relationship with the bottom wall of reservoir 27.

The sump pipes 28 (FIGS. 3 and 4) and 48 (FIGS. 5 and 6) may include filter means integral with the inlet end of the pipe to prevent the recirculation of sludge and other contaminants with the oil. This is best illustrated in FIG. 6. First leg 50 of sump pipe 48 includes cap 60 to block off the open end of the pipe. Oil enters the pipe through a plurality of spaced parallel arcuate slots 62 cut perpendicularly to the longitudinal axis of leg 50 along its bottom circumference. The width and number of these slots can be selected with regard to the sizes of solid particles to be screened from the oil and to the volume rate of oil flow necessary for proper lubrication of the engine.

Figure 8:
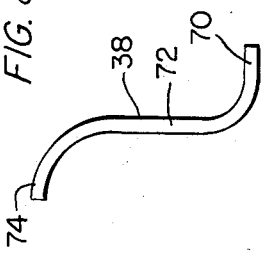
FIG. 8 is a side elevational view of a second configuration of attaching clip.
Figure 7:
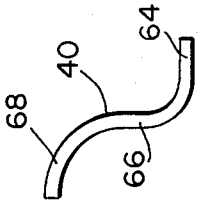
FIG. 7 is a side elevational view of one configuration of attaching clip.

FIGS. 7 and 8 illustrate in detail two different sizes of substantially reverse S-shaped attachment clips for integrally attaching the sump pipe and maintaining it in spaced parallel relationship to the bottom of the oil pan reservoir and trough. The smaller clip 40 shown in FIG. 7 is intended for securing third leg 34 to the bottom wall of trough 26 as illustrated in FIG. 3. Clip 40 includes a first horizontal portion 64, a second vertical portion 66 and third curved portion 68. Clip 38, shown in FIG. 8, is larger than clip 40 and is used to attach first leg 30 of sump pipe 28 and first leg 50 of sump pipe 48 to the bottom wall of reservoir 27. Clip 38 also includes a first horizontal portion 70, a second vertical portion 72 and a third curved portion 74. When the attachment clips are in place horizontal portions 64 and 70 rest on the bottom of the trough portion and reservoir, respectively, and may be secured thereto by welding, brazing or the like. Curved portions 68 and 74 have a radius of curvature equal to that of the sump pipe so that these portions fit securely around a section of the circumference of the pipe and can also be fastened to the pipe by welding, brazing or the like. The length of vertical portions 66 and 72 determine the distance the sump pipe is spaced from the bottom wall of the trough or reservoir. It is desirable to space the pipe a greater distance from the floor of the reservoir than from the floor of the trough portion since sludge tends to accumulate in the bottom of the reservoir and it is desirable to avoid submersing the pipe inlet therein. This prevents both the pipe oil intake slots from being blocked with sludge and the circulation through the engine of such sludge as it enters the intake slots.

Figure 9:
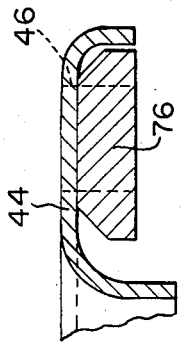
FIG. 9 is a cross-sectional view of the mounting flange of the oil pan assembly.

FIG. 9 illustrates the detail of flange 44 showing a reinforcing bar 76 welded to the lower surface of flange 44 to assist in supporting the periphery of the oil pan assembly and to assist in forming a fluid tight seal with the lower surface 12 of ladder frame 10.

Figure 10:
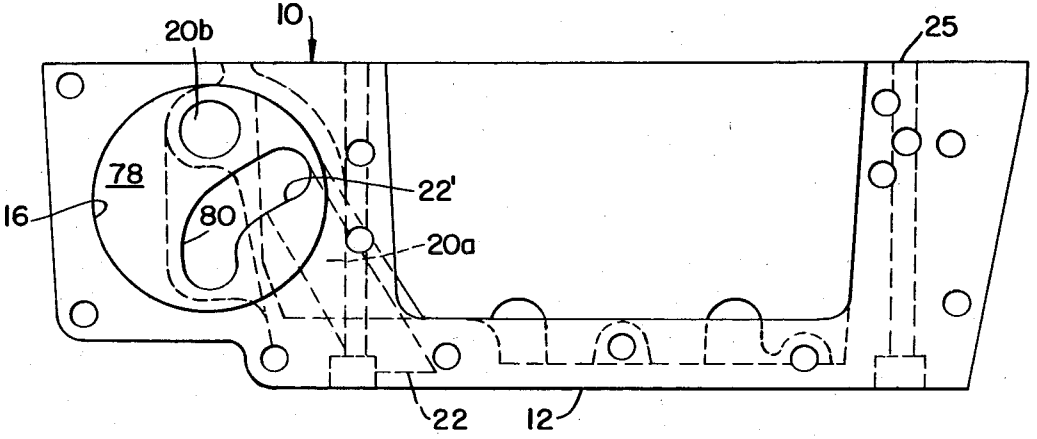
FIG. 10 is an end elevational view of the lower engine block illustrated in FIG. 1.

FIG. 10 illustrates an end view of ladder frame 10 including the bottom surface 12 for attachment of the oil pan assembly of the present invention. The same reference numerals employed in FIG. 2 are used in FIG. 10 to identify the same structural elements. As seen in FIG. 10, recess 16 is cylindrical in form. The rear wall 78 of recess 16 contains a slot 80 for connecting port 22' of passage **20*a* with the lower portion of recess 16 thereby causing oil received through the sump pipe (not shown) to be supplied to the lubrication pump (not shown) near the lower portion of recess 16. Oil is discharged by the pump through passage 20*b* opening into the upper portion of recess 16**.

Figure 11:
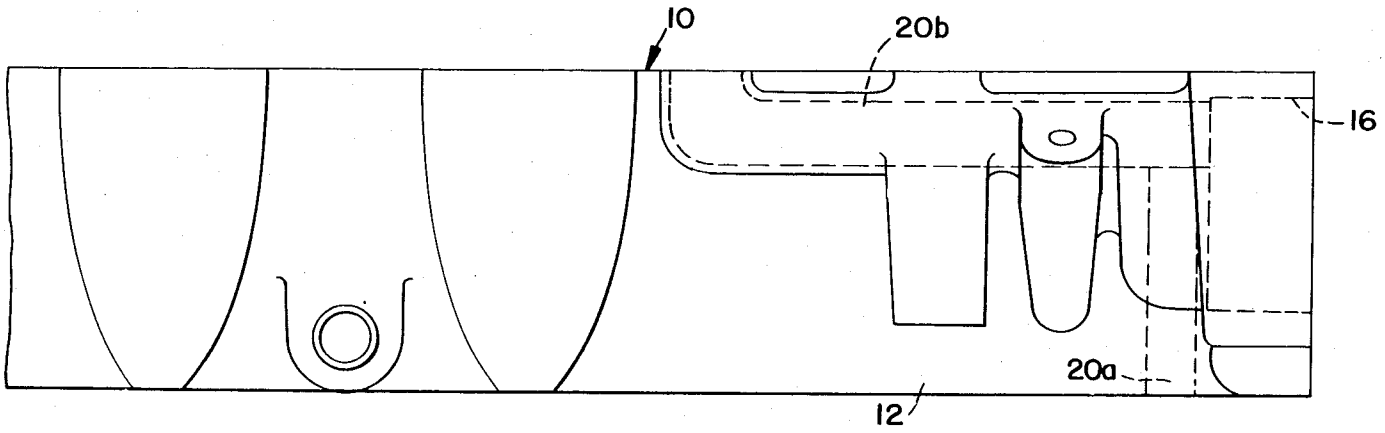
FIG. 11 is a broken elevational view of the left side of the lower engine block illustrated in FIG. 10.

FIG. 11 is a broken side elevational view of the ladder frame 10 which discloses the axial length of recess 16 and passage **20*a***.

It can now be appreciated that an oil pan assembly and ladder frame have been disclosed which together provide a greatly simplified internal combustion engine assembly characterized by integrally formed components which were heretofore manufactured and assembled as separate elements. In addition to reduction in assembly costs, the integrally formed components provide numerous functional advantages. For example, by forming an oil pump receiving cavity in the ladder frame, the conventional oil pump housing has been eliminated altogether, thereby eliminating the need for internally formed mounting supports and supply and exhaust line seal joints required by the conventional type of oil pump housing. By positioning the oil pump receiving recess 16 in the ladder frame as described above, the oil pump may be very easily assembled and positioned to be driven by gear connection with the crankshaft. An even more important advantage of the present invention is the provision of an oil pan assembly including an oil pan which may be stamped from sheet metal in a configuration which is adapted to be reversibly mounted on the engine block in dependence upon the intended environment in which the engine is to be used. The subject invention also provides a method for mounting a reversible oil pan on an engine having an internalized oil recirculation circuit. In particular, the method includes integrally connecting an appropriately formed sump pipe with the oil pan assembly in a manner to achieve all the desirable features of ease in assembly without the expense of forming two different oil pans for different applications of the same engine.

INDUSTRIAL APPLICABILITY

The present invention has particular application to internal combustion engines designed to have a very high strength to weight ratio such as the engine block assembly described in application Ser. No. 022,647. Such engines, normally of the compression ignition type, may be employed in over-the-road vehicles, portable compression units and marine propulsion systems, as well as other industrial applications.

I claim:

1. An oil pan assembly for mounting on an internal combustion engine equipped with a lubrication system designed to obtain oil from the oil pan assembly through an inlet port on the engine positioned asymmetrically within the perimeter of the oil pan assembly when the assembly is mounted on the engine, said oil pan assembly comprising:

a. oil pan means having first and second operative states for storing a supply of oil, said oil pan means including a relatively deep oil reservoir section connected to at least one relatively shallow oil trough section, said oil pan means also including a mounting means for mounting said oil pan means to the engine such that said oil reservoir section is positioned forwardly of the engine while said oil trough section is positioned rearwardly of the engine when said oil pan means is operating in said first state and said oil reservoir section is positioned rearwardly of the engine while said oil trough section is positioned forwardly of the engine when said oil pan means is operating in said second state, said mounting means including flange means containing a plurality of holes spaced to permit bolts to be inserted through all of said holes to mount said assembly to the engine when said oil reservoir section is positioned forwardly of the engine and when said assembly is reversed so that said oil reservoir section is positioned rearwardly of the engine; and b. means contained entirely within the interior of said oil pan means for conveying oil from the lower inside portion of said oil reservoir section to the engine inlet port when said oil pan means is operating in one of said states and for rendering said oil pan means inoperative in the remaining state, said means for conveying oil including a pipe structure, said means for conveying oil also including attaching means for integrally attaching said pipe structure to said oil pan means such that one end of said pipe structure is automatically aligned with the engine inlet port only when said oil pan means is operating in said one of said states.

2. An oil pan assembly as set forth in claim 1, wherein when said oil pan means is operating in said first state said pipe structure includes a first leg parallel to the lower wall of said oil reservoir section and a second leg connected at one end to said first leg, said second leg extending generally vertically upwardly toward the inlet port when said pipe structure is integrally attached to said oil pan means and said oil pan means is secured to the engine in said forward alignment.

3. An oil pan assembly as set forth in claim 1, wherein when said oil pan means is operating in said second state said pipe structure includes a first leg parallel to the lower wall of said oil reservoir section, a second leg connected at one end to said first leg and extending generally vertically upwardly for a distance constituting a substantial portion of the vertical height of said oil reservoir section and a third leg connected at one end to said second leg and extending parallel to the lower wall of said oil trough section in a generally horizontal direction toward said inlet port.

4. An oil pan assembly for mounting on an internal combustion engine equipped with an internally contained lubrication system designed to obtain oil from the oil pan assembly through an inlet port on the engine positioned asymmetrically within the perimeter of the oil pan assembly when the assembly is mounted in either a forward or a reverse alignment on the engine, said oil pan assembly comprising:

a. an oil pan structure including a relatively deep oil reservoir section and integrally inseparable therefrom at least one relatively shallow oil trough section, said oil pan structure also including mounting means for reversibly mounting said oil pan structure to the engine such that said oil reservoir section is positioned forwardly of the engine and said trough section is positioned rearwardly of the engine when said oil pan structure is secured to the engine in said forward alignment, and said oil reservoir section is positioned rearwardly of the engine and said oil trough section is positioned forwardly of the engine when said oil pan structure is secured to the engine in said reverse alignment, said mounting means including flange means containing a plurality of holes spaced to permit bolts to be inserted through all of said holes to mount said assembly to the engine when said oil reservoir section is positioned forwardly of the engine and when said assembly is reversed so that said oil reservoir section is positioned rearwardly of the engine;

b. supply means for conveying oil from the lower inside portion of said oil reservoir section to the asymmetrically positioned engine inlet port, said supply means including a pipe contaned entirely within the interior of said oil pan structure, wherein said pipe includes a first leg parallel to the lower wall of said oil reservoir section and a second leg connected at one end to said first leg, said second leg extending generally vertically upwardly toward the inlet port when said pipe is integrally attached to said oil pan structure and said oil pan structure is secured to the engine in said forward alignment; and c. attachment means for integrally attaching said pipe to said oil pan structure to cause one end of said pipe to be aligned automatically with the inlet port only when said oil pan structure is secured to the engine in said forward alignment.

5. An oil pan assembly for mounting on an internal combustion engine equipped with an internally contained lubrication system designed to obtain oil from the oil pan assembly through an inlet port on the engine positioned asymmetrically within the perimeter of the oil pan assembly when the assembly is mounted in either a forward or a reverse alignment on the engine, said oil pan assembly comprising:

a. an oil pan structure including a relatively deep oil reservoir section and integrally inseparable therefrom at least one relatively shallow oil trough section, said oil pan structure also including mounting means for reversibly securing said oil pan structure to the engine such that said oil reservoir section is positioned forwardly of the engine and said trough section is positioned rearwardly of the engine when said oil pan structure is secured to the engine in said forward alignment, and said oil reservoir section is positioned rearwardly of the engine and said oil trough section is positioned forwardly of the engine when said oil pan structure is secured to the engine in said reverse alignment, said mounting means including a flange containing a plurality of holes spaced to permit bolts to be inserted through all of said holes to mount said assembly to the engine when said oil reservoir section is positioned forwardly of the engine and when said assembly is reversed so that said oil reservoir section is positioned rearwardly of the engine;

b. supply means for conveying oil from the lower inside portion of said oil reservoir section to the asymmetrically positioned engine inlet port, said supply means including a pipe contained entirely within the interior of said oil pan structure wherein said pipe includes a first leg parallel to the lower wall of said oil reservoir section, a second leg connected at one end to said first leg and extending generally vertically upwardly for a distance constituting a substantial portion of the vertical height of said oil reservoir section and a third leg connected at one end to said second leg and extending parallel to the lower wall of said oil trough section in a generally horizontal direction toward said inlet port; and c. attachment means for integrally attaching said pipe to said oil pan structure to cause one end of said pipe to be aligned automatically with the inlet port only when said oil pan structure is secured to the engine in said reverse alignment.

6. An oil pan assembly as claimed in claims 4 or 5 wherein said first leg of said pipe includes filter means for straining the oil to be conveyed to said inlet port.

7. An oil pan assembly as claimed in claim 6, wherein said filter means includes a plurality of spaced parallel arcuate slots contained along a portion of the circumference of said first leg of said pipe.

8. An oil pan assembly as set forth in claims 4 or 5, wherein said oil reservoir section and said oil trough section are integrally formed from a single piece of material.

* * * * *